US012486732B2

(12) United States Patent
Frost

(10) Patent No.: US 12,486,732 B2
(45) Date of Patent: Dec. 2, 2025

(54) DOWNHOLE ACTIVATED TRIGGER DEVICE AND ASSOCIATED TOOLS AND METHODS

(71) Applicant: ODESSA SEPARATOR, INC., Odessa, TX (US)

(72) Inventor: Cavin Bert Frost, Odessa, TX (US)

(73) Assignee: ODESSA SEPARATOR, INC., Odessa, TX (US)

( * ) Notice: Subject to any disclaimer, the term of this patent is extended or adjusted under 35 U.S.C. 154(b) by 0 days.

(21) Appl. No.: 18/350,894

(22) Filed: Jul. 12, 2023

(65) Prior Publication Data

US 2024/0018843 A1 Jan. 18, 2024

Related U.S. Application Data

(60) Provisional application No. 63/368,354, filed on Jul. 13, 2022.

(51) Int. Cl.

| | |
|---|---|
| ***E21B 33/12*** | (2006.01) |
| ***E21B 23/04*** | (2006.01) |
| ***E21B 33/127*** | (2006.01) |
| ***E21B 34/08*** | (2006.01) |

(52) U.S. Cl.

CPC ..... *E21B 33/1208* (2013.01); *E21B 23/04* (2013.01); *E21B 23/0411* (2020.05); *E21B 33/127* (2013.01); *E21B 34/08* (2013.01); *E21B 2200/06* (2020.05)

(58) Field of Classification Search

CPC ..... E21B 23/04; E21B 23/0411; E21B 34/08; E21B 43/08; E21B 2200/06; E21B 33/127; E21B 33/1291; E21B 33/1208

See application file for complete search history.

(56) References Cited

U.S. PATENT DOCUMENTS

| | | | | |
|---|---|---|---|---|
| 2,978,028 | A * | 4/1961 | Webb | E21B 23/065 166/134 |
| 4,347,899 | A * | 9/1982 | Weeter | E21B 43/123 166/371 |
| 2007/0246225 | A1* | 10/2007 | Hailey | E21B 43/12 166/332.8 |
| 2014/0374119 | A1* | 12/2014 | Dewars | E21B 33/1295 166/120 |
| 2022/0186578 | A1* | 6/2022 | Least | E21B 34/14 |

OTHER PUBLICATIONS

Odessa Separator, Inc., Chem Screen with Shut Off Valve, product brochure, dated 2022, 1 page.

* cited by examiner

*Primary Examiner* — Nicole Coy
*Assistant Examiner* — Jennifer A Railey
(74) *Attorney, Agent, or Firm* — Smith IP Services, P.C.

(57) ABSTRACT

A downhole activated trigger device can include a swellable material, a pivot arm, an actuation sleeve and a release sleeve configured to displace from a run-in position to an actuated position in response to swelling of the swellable material. A system can include a downhole activated trigger device comprising a swellable material configured to swell in response to contact with a well fluid, and a well tool configured to actuate in response to swelling of the swellable material. A method of actuating a well tool can include connecting the well tool and a downhole activated trigger device in a tubular string, positioning the tubular string in the well, contacting a swellable material of the downhole activated trigger device with a well fluid, and the well tool actuating in response to the swellable material contacting the well fluid.

11 Claims, 8 Drawing Sheets

DOWNHOLE ACTIVATED TRIGGER DEVICE AND ASSOCIATED TOOLS AND METHODS

BACKGROUND

This disclosure relates generally to equipment utilized and operations performed in conjunction with a subterranean well and, in an example described below, more particularly provides a downhole activated trigger device and associated tools and methods.

Various systems have been developed for actuating downhole well tools. Examples of such actuators include electrical, hydraulic and mechanical actuators. These types of actuators allow an operator to delay actuation of a well tool until it is desired for the well tool to be actuated.

However, each of the prior actuation systems has a distinct disadvantage. Therefore, it will be appreciated that advancements are continually needed in the art of actuating downhole well tools. Such advancements may be used to actuate a wide variety of different well tools.

DETAILED DESCRIPTION

Figure 1:
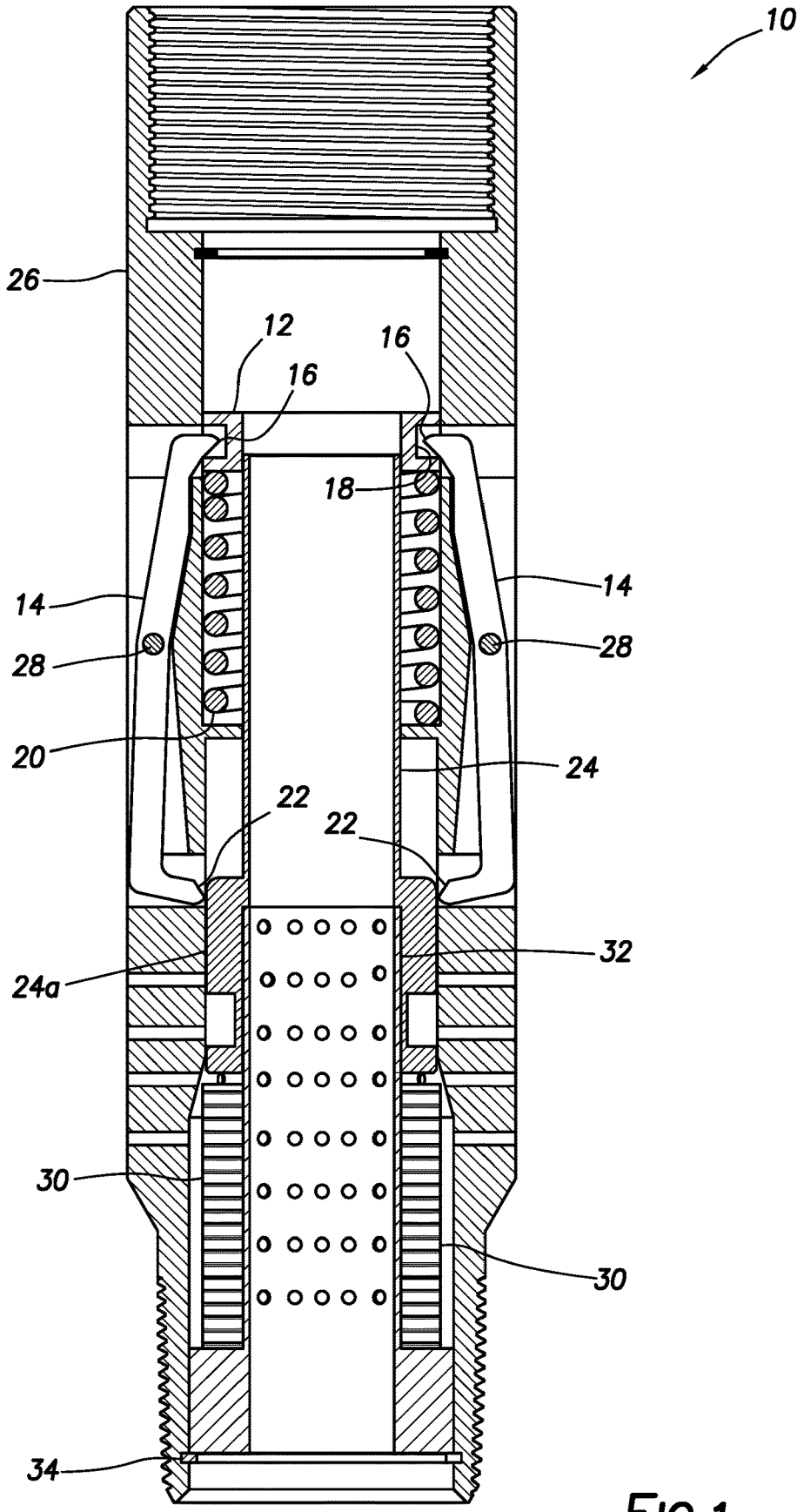
FIG. 1 is a representative cross-sectional view of an example of a downhole activated trigger device and associated method which can embody principles of this disclosure.

Representatively illustrated in FIG. 1 is a downhole activated trigger device 10 and associated method which can embody principles of this disclosure. However, it should be clearly understood that the device 10 and method are merely one example of an application of the principles of this disclosure in practice, and a wide variety of other examples are possible. Therefore, the scope of this disclosure is not limited at all to the details of the device 10 and method described herein and/or depicted in the drawings.

As depicted in FIG. 1, the device 10 is in a run-in or deactivated configuration. In this configuration, an actuation sleeve 12 is secured in position by multiple pivot arms 14. Specifically, inwardly projecting points 16 at upper ends of the pivot arms 14 engage an annular recess 18 in the actuation sleeve 12.

An upwardly directed biasing force is applied to the actuation sleeve 12 by a biasing device 20, in this case a coiled compression spring. In other examples, the biasing device 20 could be a resilient material, a compressed gas, or another type of biasing device.

To actuate a well tool downhole, the actuation sleeve 12 is displaced upward by the biasing device 20, after the actuation sleeve is released by pivoting the points 16 out of engagement with the recess 18. The upward displacement of the actuation sleeve 12 will cause the well tool connected above the device 10 to be actuated. In other examples, the well tool could be connected below the device 10.

In the FIG. 1 run-in configuration, the points 16 are prevented from disengaging from the recess 18 by abutting contact between inwardly projecting points 22 and an outer surface 24*a* of a release sleeve 24. The pivot arms 14 are pivotably mounted in a side wall of a generally tubular body 26 of the device 10 (at pivots 28), so that, in order for the points 16 at the upper ends of the pivot arms 14 to displace outward out of engagement with the recess 18, the points 22 at the lower ends of the pivot arms must be able to displace inward. The outer surface 24*a* of the release sleeve 24 prevents such inward displacement of the points 22 in the FIG. 1 run-in configuration.

A swellable material 30 is disposed in the body 26 below the release sleeve 24. In the FIG. 1 example, the swellable material 30 is in the form of multiple annular rings surrounding a tubular perforated mandrel 32 secured in the body 26 with a snap ring 34. The body 26 is also perforated in an area surrounding and near the swellable material 30.

The perforations in the inner mandrel 32 allow well fluid in an interior of the device 10 to contact the swellable material 30. The perforations in the body 26 allow well fluid on an exterior of the device 10 to contact the swellable material 30. Note that it is not necessary for the inner mandrel 32 or the body 26, or any other particular element of the device 10, to be perforated. It is also not necessary for well fluids both interior to and exterior of the body 26 to contact the swellable material 30.

The swellable material 30 will swell (increase in volume) when it contacts a selected type of well fluid. For example, the swellable material 30 may be an elastomer (such as rubber) that swells when contacted with a hydrocarbon well fluid, or a hydrophilic material that swells when contacted with an aqueous well fluid.

The well fluid that causes swelling of the material 30 may be present in a well when the device 10 is deployed into the well, or the well fluid may be introduced into the well a selected amount of time after the device is deployed into the well. The swellable material 30 may swell a sufficient amount to activate the device 10 in a predetermined number of minutes, hours or days after being exposed to the well fluid that causes the material to swell.

Figure 2:
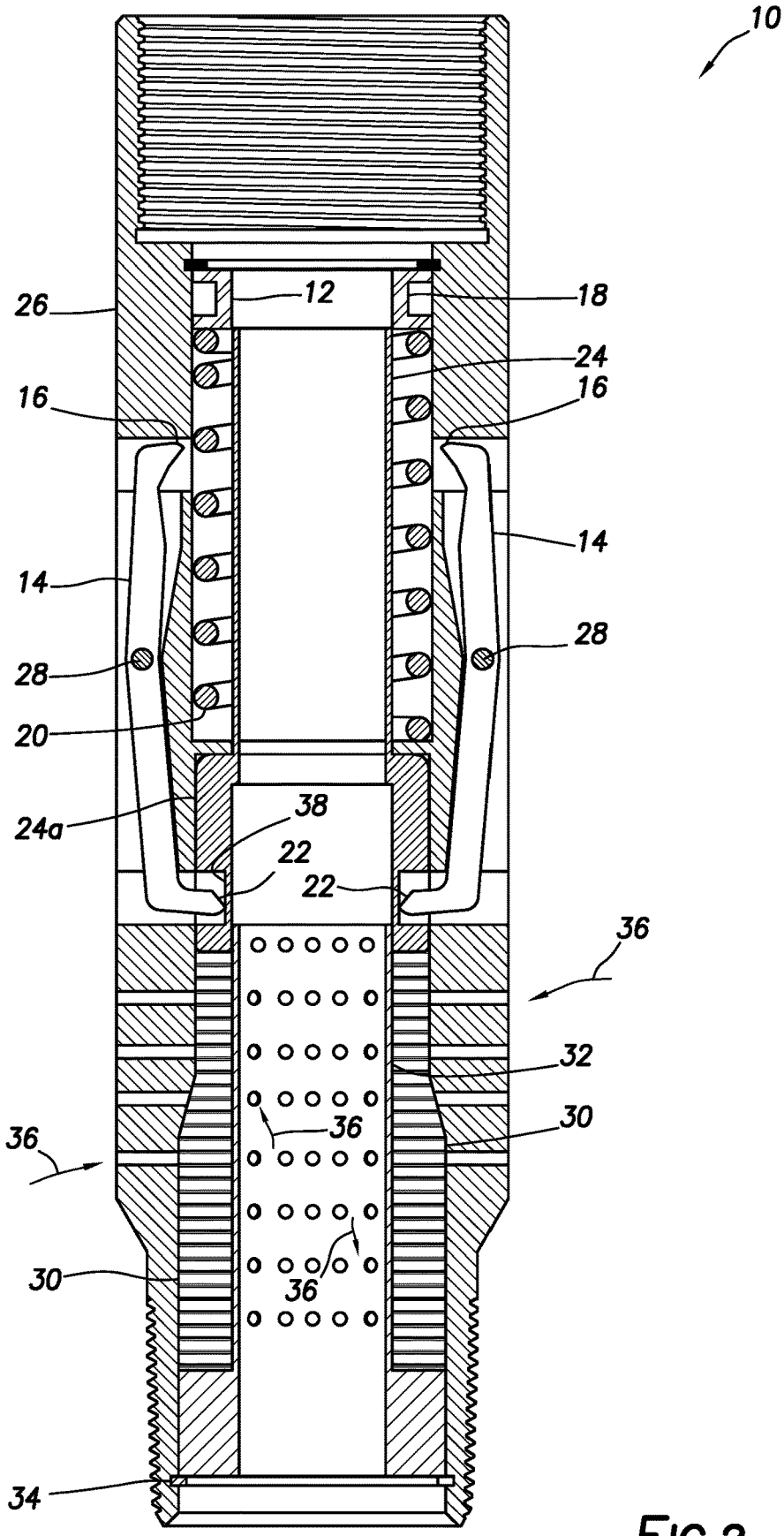
FIG. 2 is a representative cross-sectional view of the FIG. 1 downhole activated trigger device in an activated configuration.

Referring additionally now to FIG. 2, the downhole activated trigger device is representatively illustrated in an activated configuration. The swellable material 30 has swollen in response to contact with the well fluid 36 that flowed through the perforated body 26 and inner mandrel 32.

As a result of the material 30 swelling, the release sleeve 24 is displaced upward in the body 26. In this upper activated position, the outer surface 24*a* of the release sleeve 24 no longer contacts and prevents inward displacement of the points 22 at the lower ends of the pivot arms 14.

In the FIG. 2 activated position, the lower points 22 can displace inward into engagement with an annular recess 38 in the release sleeve 24. Thus, the pivot arms 14 can pivot, so that the upper points 16 can disengage from the recess 18 in the actuation sleeve 12.

When the points 16 are no longer engaged in the recess 18, the biasing force exerted by the biasing device 20 can displace the actuation sleeve 12 upward. This upward displacement of the actuation sleeve 12 can be used to actuate a well tool, as described more fully below.

Note that, in the run-in configuration of FIG. 1, the upper points 16 on the pivot arms 14 project inwardly into the interior of the body 26, and the lower points 22 do not project into the interior of the body. In the activated configuration of FIG. 2, the lower points 22 on the pivot arms 14 project inwardly into the interior of the body 26, and the upper points 16 do not project into the interior of the body.

Figure 3:
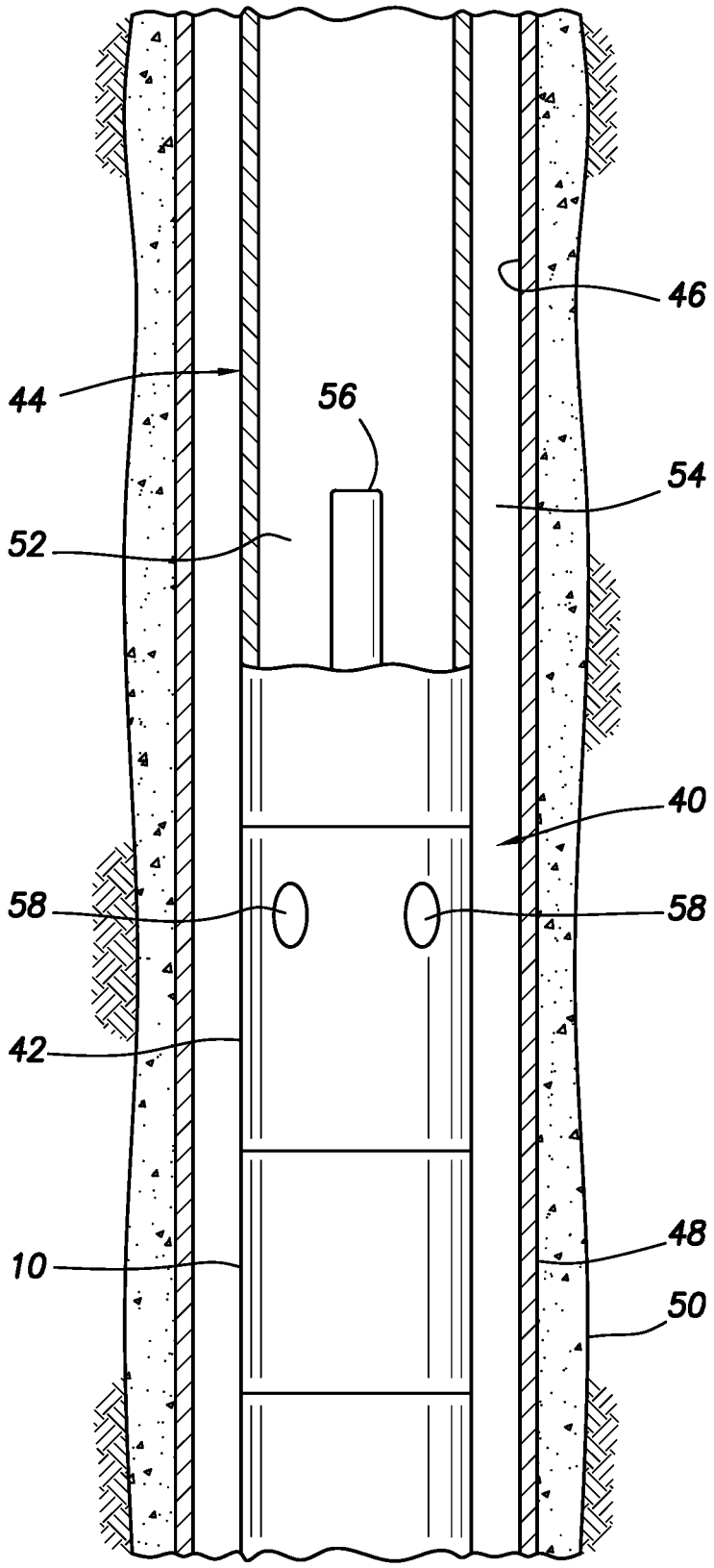
FIG. 3 is a representative partially cross-sectional view of a well system and associated method which can embody the principles of this disclosure.

Referring additionally now to FIG. 3, an example of a system 40 for use with a subterranean well is representatively illustrated. The system 40 is described herein as one example of how the principles of this disclosure can be used to actuate one example of a downhole well tool 42. However, the scope of this disclosure is not limited to the FIG. 3 example at all, since the principles described herein may be used with other systems, well tools, methods, etc.

As depicted in FIG. 3, the downhole activated trigger device 10 and the well tool 42 are connected as parts of a tubular string 44 deployed into a wellbore 46 of the well. In this example, the wellbore 46 is lined with casing 48 and cement 50, but in other examples the wellbore surrounding the device 10 and well tool 42 may be uncased or open hole.

It is desired to initially isolate a chamber 52 in an interior of the tubular string 44 from fluid communication with an exterior of the tubular string (e.g., an annulus 54 surrounding the tubular string). In this example, the delay is beneficial to postpone exposure of a chemical treatment 56 to fluid in the annulus 54, until after the tubular string 44 is fully deployed in the well and production operations are to begin. This will help to make the chemical treatment 56 last longer. The chemical treatment 56 may be a corrosion inhibitor, a paraffin treatment, or any other type of chemical treatment for use in wells.

In the FIG. 3 example, the well tool 42 comprises a valve that in a run-in configuration prevents fluid communication between the chamber 52 and the annulus 54. In an actuated configuration, the valve permits fluid communication between the chamber 52 and the annulus 54 via openings 58.

Figure 4:
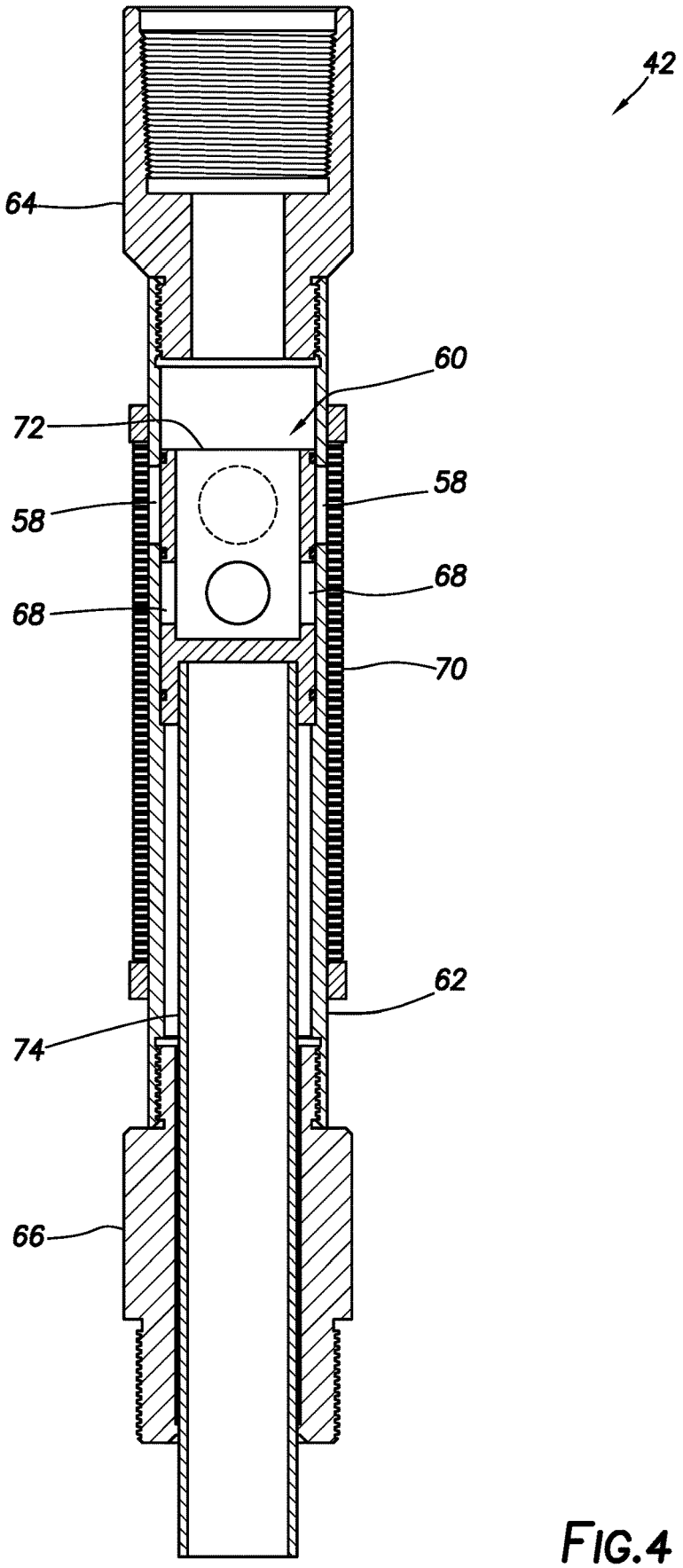
FIG. 4 is a representative cross-sectional view of a well tool that may be used in the FIG. 3 system and method.

Referring additionally now to FIG. 4, a cross-sectional view of an example of the well tool 42 is representatively illustrated. The well tool 42 is depicted in a run-in configuration in FIG. 4.

In this example, the well tool 42 comprises a valve 60 for selectively preventing and permitting fluid communication through the openings 58 between an interior and an exterior of the well tool. The openings 58 are formed through a side wall of a tubular housing 62. Threaded end connections 64, 66 are secured at opposite ends of the housing 62 for use in connecting the well tool 42 in a tubular string (such as the FIG. 3 tubular string 44).

A screen 70 is secured on the housing 62 overlying the openings 58. The screen 70 filters any flow between the interior and exterior of the well tool 42 via the openings 58.

The valve 60 includes a sliding sleeve 72 reciprocably disposed in the housing 62. In the FIG. 4 run-in configuration, the sliding sleeve 72 blocks flow through the openings 58. Openings 68 in the sliding sleeve 72 can be aligned with the openings 58 in the housing 62 when the sliding sleeve 72 is displaced upward.

A tube 74 is received in a lower end of the sliding sleeve 72 and extends downwardly therefrom. A lower end of the tube 74 extends outwardly from the lower threaded connector 66.

When the well tool 42 is connected above the downhole activated trigger device 10, the lower end of the tube 74 abuts the actuation sleeve 12 in the device 10. Thus, when the actuation sleeve 12 displaces upward in response to the swelling of the swellable material 30, the tube 74 and sliding sleeve 72 will also displace upward.

Figure 5:
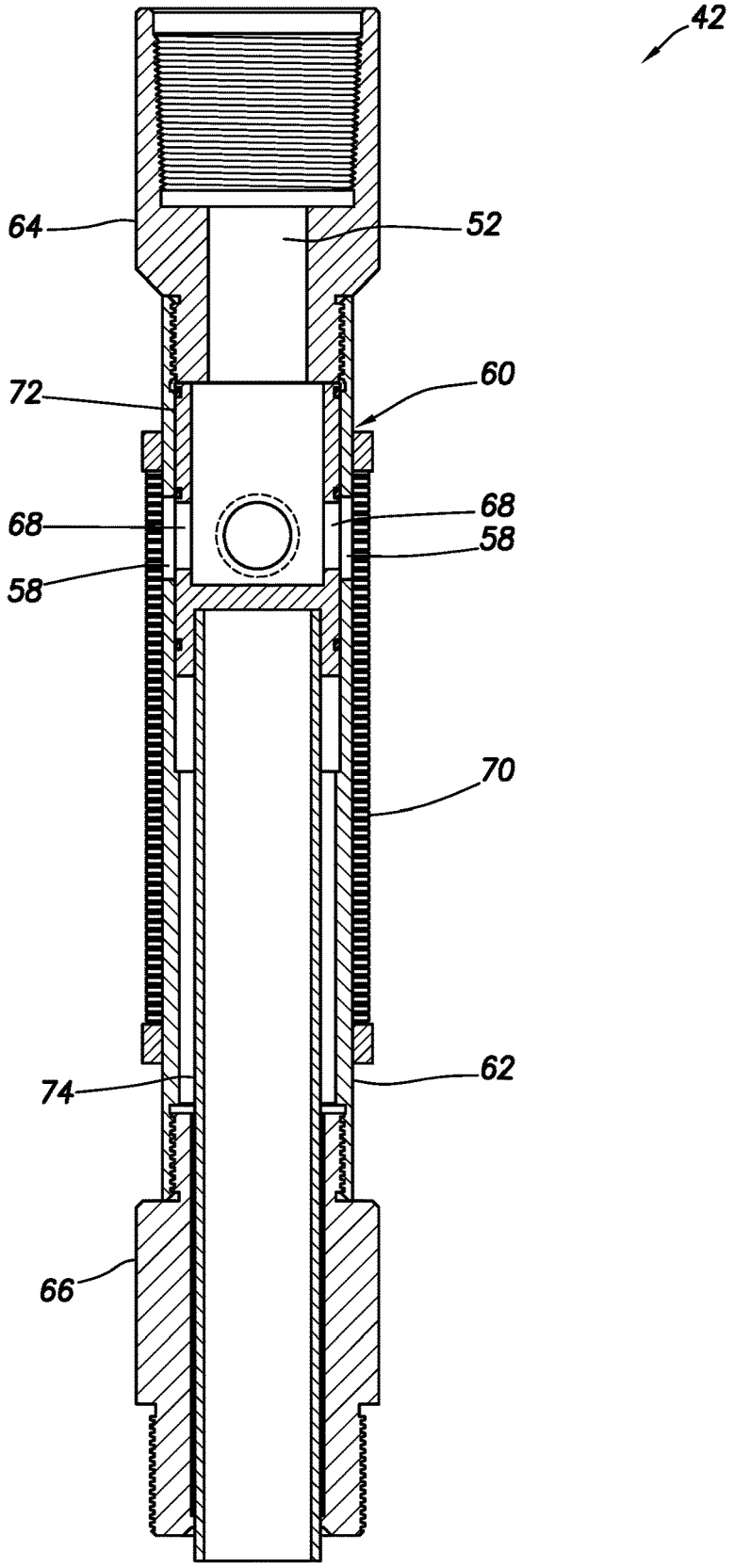
FIG. 5 is a representative cross-sectional view of the FIG. 4 well tool in an actuated configuration.

Referring additionally now to FIG. 5, the well tool 42 is representatively illustrated in an actuated configuration. In this configuration, the tube 74 and sliding sleeve 72 have been displaced upward due to upward displacement of the actuation sleeve 12 of the device 10.

The openings 58 in the housing 62 are now aligned with the openings 68 in the sliding sleeve 72. Thus, fluid communication is now permitted between the interior and exterior of the well tool 42 via the valve 60. In the FIG. 3 system 42, opening of the valve 60 allows well fluid 36 in the annulus 54 to flow into the chamber 52 and contact the chemical treatment 56, which will then leach out of the chamber and into the annulus via the screen 70.

Figure 6:
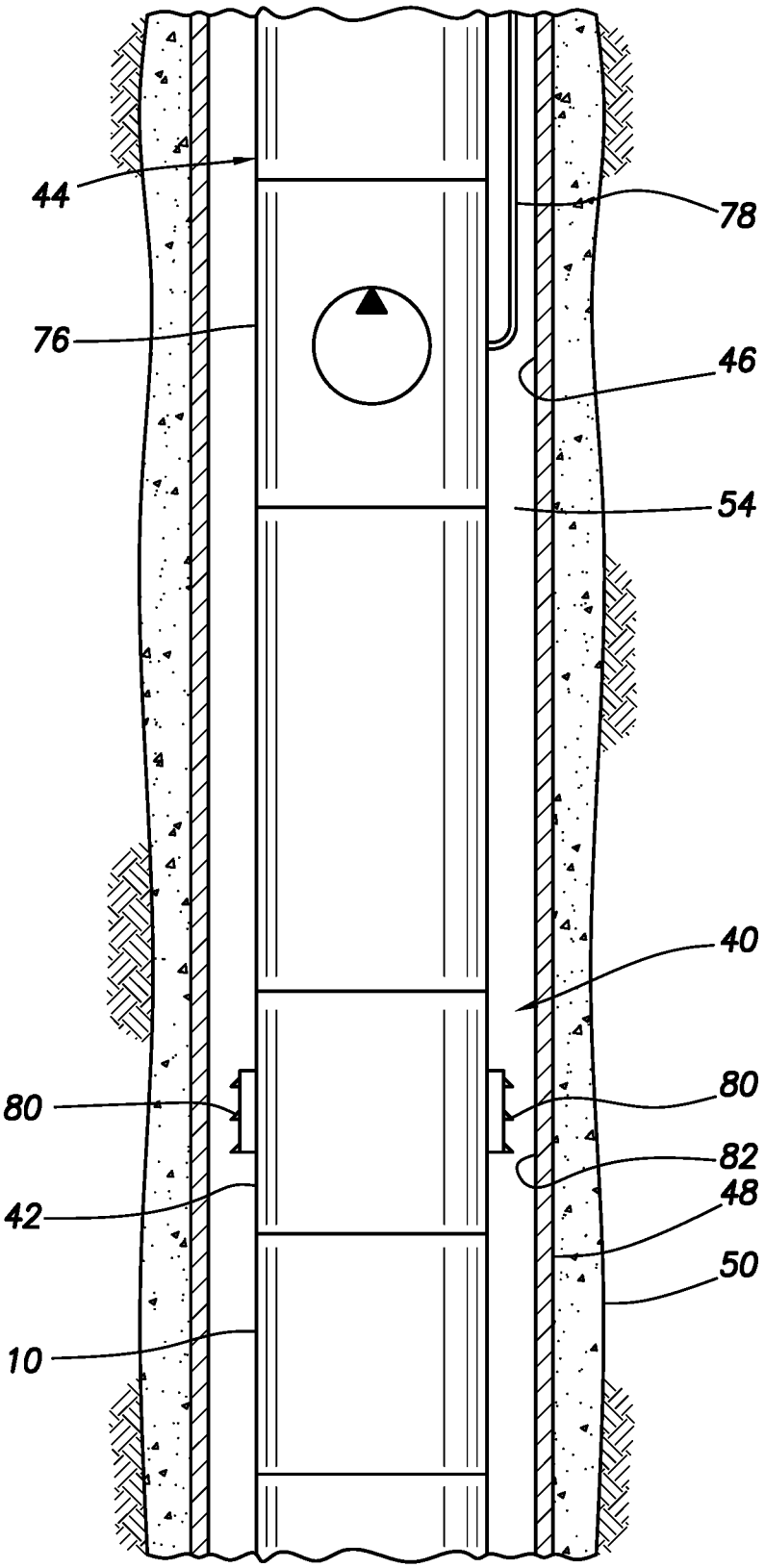
FIG. 6 is a representative partially cross-sectional view of another well system and associated method which can embody the principles of this disclosure.

Referring additionally now to FIG. 6, another example of the system 40 is representatively illustrated. In this example, the well tool 42 comprises an anchor for securing the tubular string 44 in the wellbore 46.

As depicted in FIG. 6, an electric submersible pump 76 is connected in the tubular string 44 above the anchor/well tool 42. The presence of the electric submersible pump 76 makes use of a conventional anchor problematic, due to the need for electric cables 78 in the annulus 54. The electric cables 78 restrict rotation of the tubular string 44 in the wellbore 46, thus limiting pipe manipulations that otherwise could be used to set the anchor.

In the FIG. 6 example, the well tool 42 includes outwardly extendable slips 80 for gripping a well surface 82 surrounding the well tool. The well surface 82 could be an interior surface of casing 48 (or liner or tubing, etc.), or an interior surface of an open hole or uncased wellbore.

One benefit of the FIG. 6 system 40 is that the downhole activated trigger device 10 can be used to set the anchor/well tool 42, without requiring any manipulations of the tubular string 44 (other than using the tubular string to deploy the trigger device 10 and the well tool 42 into the wellbore 46). The swellable material 30 (see FIGS. 1 & 2) can be selected, so that the anchor is set a predetermined amount of time after the trigger device 10 and anchor are deployed into the well and the well fluid 36 contacts the swellable material.

Figure 7:
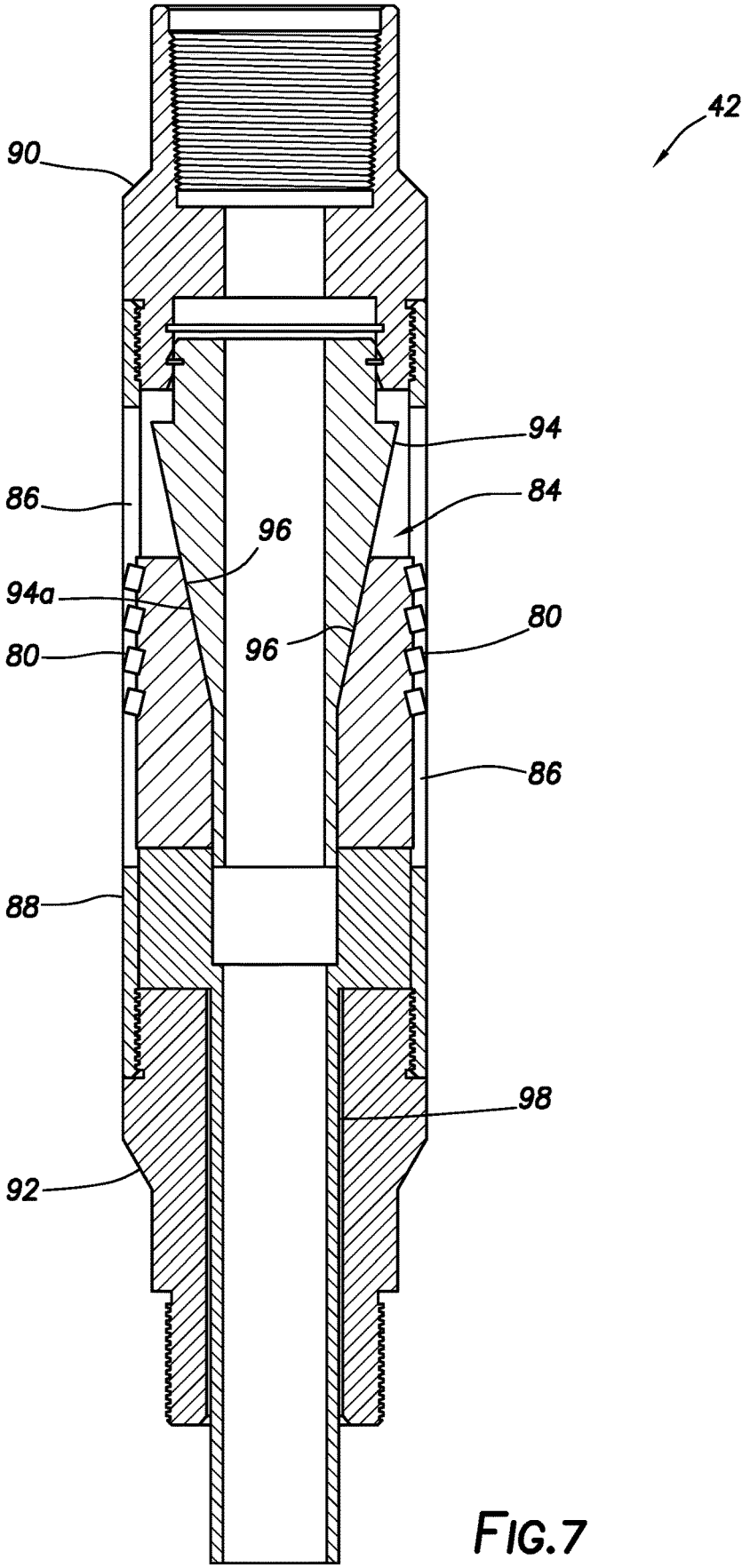
FIG. 7 is a representative cross-sectional view of a well tool that may be used in the FIG. 6 system and method.

Referring additionally now to FIG. 7, a cross-sectional view of another example of the well tool 42 is representatively illustrated. The well tool 42 is in a run-in configuration as depicted in FIG. 7.

The FIG. 7 well tool 42 comprises an anchor 84. The anchor 84 includes the slips 80, which are outwardly extendable through longitudinally extending slots 86 in an outer housing 88.

The outer housing 88 is connected between threaded end connections 90, 92. A frusta-conical wedge 94 extends downwardly from the upper end connection 90. An outer tapered surface 94*a* on the wedge 94 slidingly contacts inner inclined surfaces 96 on the slips 80.

A tubular inner mandrel 98 extends through the lower end connection 92. An upper end of the inner mandrel 98 abuts a lower end of the slips 80. Thus, if the inner mandrel 98 is displaced upward, the slips 80 will also displace upward, and the sliding contact between the tapered and inclined surfaces 94*a*, 96 will cause the slips 80 to displace outward through the slots 86.

When the FIG. 7 well tool 42 is connected to the trigger device 10, a lower end of the inner mandrel 98 will abut an upper end of the actuation sleeve 12 (see FIG. 1). Thus, upward displacement of the actuation sleeve 12 in response to swelling of the swellable material 30 will cause the inner mandrel 98 to displace upward, thereby setting the anchor 84.

Figure 8:
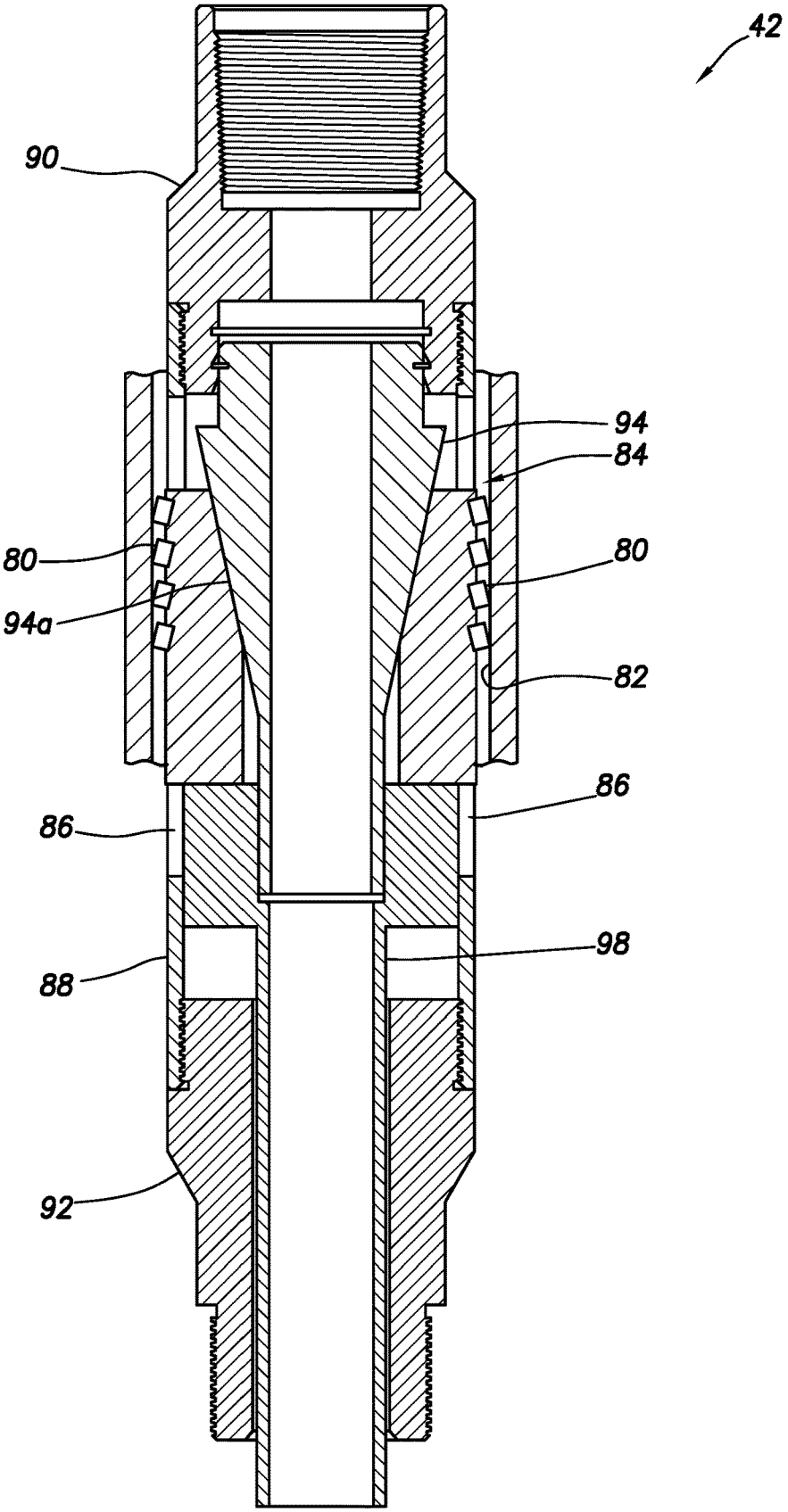
FIG. 8 is a representative cross-sectional view of the FIG. 7 well tool in an actuated configuration.

Referring additionally now to FIG. 8, another cross-sectional view of the FIG. 7 well tool 42 is representatively illustrated. The well tool 42 is depicted in an actuated configuration in FIG. 8.

In the FIG. 8 actuated configuration, the inner mandrel 98 has been displaced upward by the actuation sleeve 12 in response to the swelling of the swellable material 30. The inner mandrel 98 has pushed the slips 80 upward relative to the wedge 94.

As a result, the slips 80 have also displaced outward into gripping contact with the well surface 82. This secures the tubular string 44 against falling through the wellbore 46 (see FIG. 6). The anchor 84 is set in the FIG. 8 actuated configuration.

Although two specific illustrated examples of the well tool 42 are described above, the scope of this disclosure is not limited to use of the trigger device 10 with either of those examples. Instead, the trigger device 10 may be used to control actuation of a wide variety of different types of well tools.

Multiple trigger devices 10 and well tools 42 may be connected in a single tubular string 44. The swellable materials 30 of the respective trigger devices 10 may be selected so that the well tools 42 are actuated simultaneously, or in a preselected sequence, after the swellable materials are exposed to the well fluid 36 that causes the swellable materials to swell.

It may now be fully appreciated that the above disclosure provides significant advancements to the art of actuating downhole well tools. In examples described above, the downhole activated trigger device 10 utilizes a swellable material 30 to control actuation of various well tools 42.

The above disclosure provides to the art a downhole activated trigger device 10. In one example, the trigger device 10 can comprise a swellable material 30 adapted to swell in response to contact with a predetermined well fluid 36, a pivot arm 14 configured to pivot between first and second positions, and an actuation sleeve 12. The pivot arm 14 prevents displacement of the actuation sleeve 12 when the pivot arm 14 is in the first position, and displacement of the actuation sleeve 12 is permitted when the pivot arm 14 is in the second position. A release sleeve 24 has run-in and actuated positions, in the run-in position the release sleeve 24 prevents the pivot arm 14 from pivoting from the first position to the second position, and in the actuated position the release sleeve 24 permits the pivot arm 14 to pivot from the first position to the second position. The release sleeve 24 is configured to displace from the run-in position to the actuated position in response to swelling of the swellable material 30.

The downhole activated trigger device 10 may include a biasing device 20 that applies a biasing force against the actuation sleeve 12. The biasing force displaces the actuation sleeve 12 in response to the pivot arm 14 being pivoted to the second position.

An inwardly projecting first point 16 on the pivot arm 14 may engage a first recess 18 in the actuation sleeve 12 when the pivot arm 14 is in the first position. An inwardly projecting second point 22 on the pivot arm 14 may engage a second recess 38 in the release sleeve 24 when the pivot arm 14 is in the second position.

The pivot arm 14 may be disposed in a side wall of a generally tubular body 26. A first point 16 at an end of the pivot arm 14 may project into an interior of the body 26 when the pivot arm 14 is in the first position, and a second point 22 at an opposite end of the pivot arm 14 projects into the interior of the body 26 when the pivot arm 14 is in the second position.

The first point 16 may engage and prevents displacement of the actuation sleeve 12 in the first position, and the release sleeve 24 may prevent disengagement of the first point 16 from the actuation sleeve 12 in the run-in position.

The above disclosure also provides to the art a system 40 for use with a subterranean well. In one example, the system 40 can comprise a downhole activated trigger device 10 comprising a swellable material 30 configured to swell in response to contact with a well fluid 36, and at least one well tool 42 configured to actuate in response to swelling of the swellable material 30.

The well tool 42 may comprise a valve 60 that selectively prevents and permits fluid communication between an exterior and an interior of a tubular string 44. The system 40 may also include a chemical treatment 56 in the interior of the tubular string 44. A sliding sleeve 72 of the valve 60 may be configured to displace to an open position in response to the swelling of the swellable material 30.

The well tool 42 may comprise an anchor 84 that selectively grips a well surface 82 surrounding the anchor 84. Slips 80 of the anchor 84 may be configured to displace outward in response to the swelling of the swellable material 30. A wedge 94 of the anchor 84 may be configured to displace to an actuated position in response to the swelling of the swellable material 30.

A method of actuating a well tool 42 in a subterranean well is also described above. In one example, the method can comprise: connecting the well tool 42 and a downhole activated trigger device 10 in a tubular string 44; positioning the tubular string 44 in the well; contacting a swellable material 30 of the downhole activated trigger device 10 with a well fluid 36; and the well tool 42 actuating in response to the swellable material 30 contacting the well fluid 36.

The contacting step may comprise swelling the swellable material 30, thereby displacing an actuation sleeve 12 of the downhole activated trigger device 10. The displacing step may comprise releasing the actuation sleeve 12 by pivoting a pivot arm 14 from a first position to a second position.

The pivoting step may comprise permitting an inwardly projecting point 22 of the pivot arm 14 to engage a recess 38 in a release sleeve 24, thereby permitting the pivot arm 14 to pivot from the first position to the second position.

The well tool 42 actuating step may comprise opening a valve 60, thereby permitting fluid communication between a chemical treatment 56 in an interior of the tubular string 44 and an annulus 54 surrounding the tubular string 44. The well tool 42 actuating step may comprise setting an anchor 84, thereby securing the tubular string 44 to a well surface 82 surrounding the tubular string 44.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used.

Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A downhole activated trigger device, comprising:

a swellable material adapted to swell in response to contact with a predetermined well fluid;

a pivot arm configured to pivot between first and second positions;

an actuation sleeve, the pivot arm prevents displacement of the actuation sleeve when the pivot arm is in the first position, and displacement of the actuation sleeve is permitted when the pivot arm is in the second position; and a release sleeve having run-in and actuated positions, in the run-in position the release sleeve prevents the pivot arm from pivoting from the first position to the second position, and in the actuated position the release sleeve permits the pivot arm to pivot from the first position to the second position, in which the release sleeve is configured to displace from the run-in position to the actuated position in response to swelling of the swellable material.

2. The downhole activated trigger device of claim 1, further comprising a biasing device that applies a biasing force against the actuation sleeve.

3. The downhole activated trigger device of claim 2, in which the biasing force displaces the actuation sleeve in response to the pivot arm being pivoted to the second position.

4. The downhole activated trigger device of claim 1, in which an inwardly projecting first point on the pivot arm engages a first recess in the actuation sleeve when the pivot arm is in the first position.

5. The downhole activated trigger device of claim 4, in which an inwardly projecting second point on the pivot arm engages a second recess in the release sleeve when the pivot arm is in the second position.

6. The downhole activated trigger device of claim 1, in which the pivot arm is disposed in a side wall of a generally tubular body, a first point at an end of the pivot arm projects into an interior of the body when the pivot arm is in the first position, and a second point at an opposite end of the pivot arm projects into the interior of the body when the pivot arm is in the second position.

7. The downhole activated trigger device of claim 6, in which the first point engages and prevents displacement of the actuation sleeve in the first position, and the release sleeve prevents disengagement of the first point from the actuation sleeve in the run-in position.

8. A method of actuating a well tool in a subterranean well, the method comprising:

connecting the well tool and a downhole activated trigger device in a tubular string;

positioning the tubular string in the well;

contacting a swellable material of the downhole activated trigger device with a well fluid, thereby swelling the swellable material;

releasing an actuation sleeve of the downhole activated trigger device by pivoting a pivot arm from a first position to a second position; and the well tool actuating in response to the releasing.

9. The method of claim 8, in which the pivoting comprises permitting an inwardly projecting point of the pivot arm to engage a recess in a release sleeve, thereby permitting the pivot arm to pivot from the first position to the second position.

10. The method of claim 8, in which the well tool actuating comprises opening a valve, thereby permitting fluid communication between a chemical treatment in an interior of the tubular string and an annulus surrounding the tubular string.

11. The method of claim 8, in which the well tool actuating comprises setting an anchor, thereby securing the tubular string to a well surface surrounding the tubular string.

* * * * *